US008911116B2

(12) United States Patent
Blincoe et al.

(10) Patent No.: US 8,911,116 B2
(45) Date of Patent: Dec. 16, 2014

(54) LIGHT-EMITTING DIODE (LED) FLOODLIGHT

(75) Inventors: Patrick Stephen Blincoe, Kirkville, NY (US); Kantesh Vittal Agnihotri, Syracuse, NY (US); Gregg Lehman, Peachtree City, GA (US); Rajendra Kage, Bangalore (IN)

(73) Assignee: Cooper Technologies Company, Houston, TX (US)

( * ) Notice: Subject to any disclaimer, the term of this patent is extended or adjusted under 35 U.S.C. 154(b) by 424 days.

(21) Appl. No.: 13/436,172

(22) Filed: Mar. 30, 2012

(65) Prior Publication Data

US 2012/0250321 A1 Oct. 4, 2012

Related U.S. Application Data

(60) Provisional application No. 61/470,554, filed on Apr. 1, 2011.

(51) Int. Cl.

| | |
|---|---|
| ***F21V 29/00*** | (2006.01) |
| ***F21V 7/00*** | (2006.01) |
| ***F21V 21/00*** | (2006.01) |

(52) U.S. Cl.

CPC .. *F21V 7/00* (2013.01); *F21V 21/00* (2013.01)
USPC ..... 362/294; 362/249.02; 362/311.02; 362/373

(58) Field of Classification Search

USPC ..... 362/249.02–249.06, 294, 311.02, 373, 362/800
See application file for complete search history.

(56) References Cited

U.S. PATENT DOCUMENTS

| | | | |
|---|---|---|---|
| D136,799 | S | 12/1943 | Vendope |
| D625,870 | S | 10/2010 | Feigenbaum |
| 7,854,534 | B2 | 12/2010 | Liu |
| 7,918,591 | B2 | 4/2011 | Lynch |

(Continued)

FOREIGN PATENT DOCUMENTS

| | | |
|---|---|---|
| KR | 10-2008-0000034 | 1/2008 |
| KR | 20-0447539 | 2/2010 |
| KR | 100945420 | 8/2010 |
| KR | 10-0997746 | 12/2010 |

OTHER PUBLICATIONS

Cooper Crouse-Hinds, "VMVIG and DMVIG Series CHAMP Induction Luminaires with Induction Lighting System", Product Brochure, Jun. 2005, pp. 1-8, Cooper Crouse-Hinds, USA.

(Continued)

*Primary Examiner* — Stephen F Husar
(74) *Attorney, Agent, or Firm* — King & Spalding LLP

(57) ABSTRACT

A light emitting diode (LED) floodlight is described herein. The LED floodlight can include a LED housing assembly coupled to a driver assembly. The LED housing can include a number of LEDs mounted on a front side of a LED housing and a number of heat sink protrusions extending from a back side of the LED housing. The driver assembly can include a driver mounted within a driver housing, where the front side of the driver housing couples to the end of the heat sink protrusions that extend from the back side of the LED housing. The LEDs may be coupled to a number of reflectors. The reflectors can include a reflector body having a top portion and a bottom portion. The top portion can form a shape that is an elongated version of the shape formed by the bottom portion.

20 Claims, 12 Drawing Sheets

(56) References Cited

U.S. PATENT DOCUMENTS

| | | | |
|---|---|---|---|
| D641,905 | S | 7/2011 | Janssen |
| 7,993,033 | B2 | 8/2011 | Moriyama et al. |
| D645,593 | S | 9/2011 | Janssen |
| D645,594 | S | 9/2011 | Grawe |
| 8,057,057 | B2 | 11/2011 | Park |
| D650,505 | S | 12/2011 | Oka |
| D663,877 | S | 7/2012 | Quevy et al. |
| D667,582 | S | 9/2012 | Toft |
| 8,292,449 | B2 | 10/2012 | Poissonnet et al. |
| 2008/0062682 | A1 | 3/2008 | Hoelen et al. |
| 2010/0014289 | A1 | 1/2010 | Thomas et al. |
| 2010/0259935 | A1 | 10/2010 | Scordino et al. |
| 2011/0019416 | A1 | 1/2011 | Poissonnet et al. |
| 2011/0068708 | A1 | 3/2011 | Coplin et al. |
| 2011/0110081 | A1 | 5/2011 | Belknap et al. |
| 2011/0141728 | A1 | 6/2011 | Russello et al. |
| 2011/0235330 | A1 | 9/2011 | Pedersen et al. |
| 2011/0242822 | A1 | 10/2011 | Rong et al. |
| 2011/0242828 | A1* | 10/2011 | Blincoe et al. ..... 362/373 |
| 2011/0249427 | A1 | 10/2011 | Rooms et al. |
| 2011/0309751 | A1 | 12/2011 | Ter-Hovhannisyan |

OTHER PUBLICATIONS

Cooper Crouse-Hinds, "Flood Light Fixtures", Product Brochure, 2001, pp. 1-12, Cooper Crouse-Hinds, USA.

Kim,Kapbyung, International Search Report and Written Opinion—PCT/US2012/031595, Oct. 26, 2012, 9 pages, Korean Intellectual Property Office, Republic of Korea.

* cited by examiner

LIGHT-EMITTING DIODE (LED) FLOODLIGHT

CROSS-REFERENCE TO RELATED APPLICATIONS

The present application claims priority from U.S. Provisional Patent Application Ser. No. 61/470,554, titled "Light-Emitting Diode (LED) Floodlight" and filed on Apr. 1, 2011, in the names of Patrick Stephen Blincoe, Kantesh Vittal Agnihotri, and Gregg Lehman, the entire contents of which are hereby incorporated herein by reference.

TECHNICAL FIELD

The present disclosure relates generally to floodlights and more particularly to systems, methods, and devices for a light emitting diode (LED) floodlight and a reflector.

BACKGROUND

Floodlights are used in many different applications. Such floodlights may be used, for example, in commercial applications and residential applications. Floodlights may also be used in industrial applications and other harsh environments, including but not limited to military applications, onboard ships, assembly plants, power plants, oil refineries, and petrochemical plants. When a floodlight is used in such harsh environments, the floodlight must comply with one or more standards and/or regulations to ensure safe and reliable operation. With the development of lighting technologies (e.g., light emitting diode (LED)) that offer alternatives to incandescent lamps, floodlights using such lighting technologies are becoming more common.

SUMMARY

In general, in one aspect, the disclosure relates to a light emitting diode (LED) floodlight. The LED floodlight can include a LED housing assembly having a number of LEDs mounted on a first front side of a LED housing and a number of heat sink protrusions extending from a back side of the LED housing. The LED floodlight can also include a driver assembly having a driver and a driver housing having a second front side, where the second front side is coupled to the heat sink protrusions extending from the back side of the LED housing, and where the driver controls the LEDs in the LED housing. The LED floodlight can further include a number of air gaps positioned between the second front side of the driver housing, the back side of the LED housing, and the heat sink protrusions.

In another aspect, the disclosure can generally relate to a reflector for a light source of a lighting device. The reflector can include a reflector body having a top portion and a bottom portion, where the bottom portion includes a first aperture that receives the light source and forms a first shape having a first perimeter, where the top portion includes a second aperture that receives light generated by the light source and forms a second shape having a second perimeter. The reflector can also include a fastener receiver, positioned on the reflector body, for receiving a fastener to couple the reflector to the lighting device, where the second perimeter is greater than the first perimeter, and where the second shape is an elongated version of the first shape.

These and other aspects, objects, features, and embodiments will be apparent from the following description and the appended claims.

BRIEF DESCRIPTION OF THE DRAWINGS

The drawings illustrate only exemplary embodiments and are therefore not to be considered limiting of its scope, as the exemplary embodiments may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
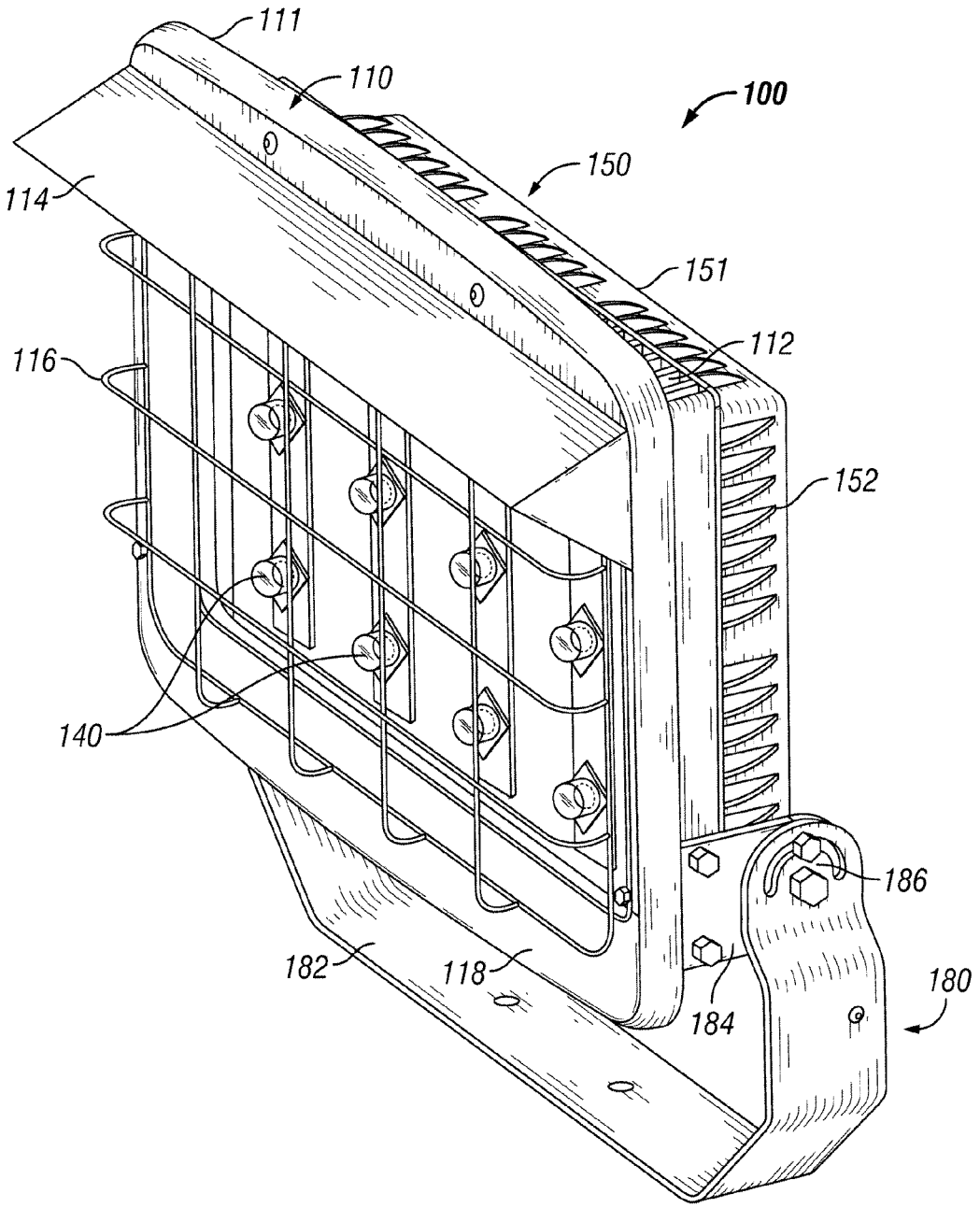
FIGS. 1A through 1C show various views of a rectangular LED floodlight in which one or more exemplary embodiments may be implemented.

Exemplary embodiments will now be described in detail with reference to the accompanying figures. Like, but not necessarily identical, elements in the various figures are denoted by like reference numerals for consistency. In the following detailed description of the exemplary embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Further, certain descriptions (e.g., top, bottom, side, end, interior, inside) are merely intended to help clarify aspects of the invention and are not meant to limit embodiments of the invention.

In general, embodiments of the invention provide systems, methods, and devices for floodlights. Specifically, embodiments of the invention provide for LED floodlights and reflectors that may be used with a floodlight. LED floodlights described herein may meet or exceed one or more of a number of standards and/or regulations that floodlights may be required to pass in order to be used for certain applications.

While the reflectors discussed herein are with reference to LED floodlights, other types of light fixtures (e.g., spotlights, nightlights, emergency egress lights) may be used in conjunction with embodiments of the reflectors. Further, when multiple reflectors described herein are used for a single light fixture, each reflector may be the same (in terms of, for example, dimensions, shape, material, and/or color) or different when compared to the other reflectors in the light fixture.

A user may be any person that interacts with a LED floodlight and/or a reflector. Examples of a user may include, but are not limited to, an engineer, an electrician, an instrumentation and controls technician, a mechanic, an operator, a consultant, a contractor, and a manufacturer's representative.

In one or more exemplary embodiments, a LED floodlight is subject to meeting certain standards and/or requirements. The International Electrotechnical Commission (IEC) publishes ratings and requirements for LED floodlights. For example, the IEC publishes IP (which stands for Ingress Protection or, alternatively, International Protection) Codes that classify and rate the degree of protection provided against intrusion of solid objects, dust, and water in mechanical casings and electrical enclosures. One such IP Code is IP66, which means that a LED floodlight having such a rating is dust tight and protects against powerful water jets (in this case, 100 liters of water per minute under a pressure of 100 $kN/m^2$ at a distance of 3 meters) for a duration of at least 3 minutes.

The IEC also publishes temperature ratings for electrical equipment. For example, if a device is classified as having a T4 temperature rating, then the surface temperature of the device will not exceed 135° C. Other entities (e.g., the National Electrical Manufacturers Association (NEMA), the National Electric Code (NEC), Underwriters' Laboratories, Inc. (UL)) may also publish standards and/or requirements for LED floodlights.

Figure 1B:
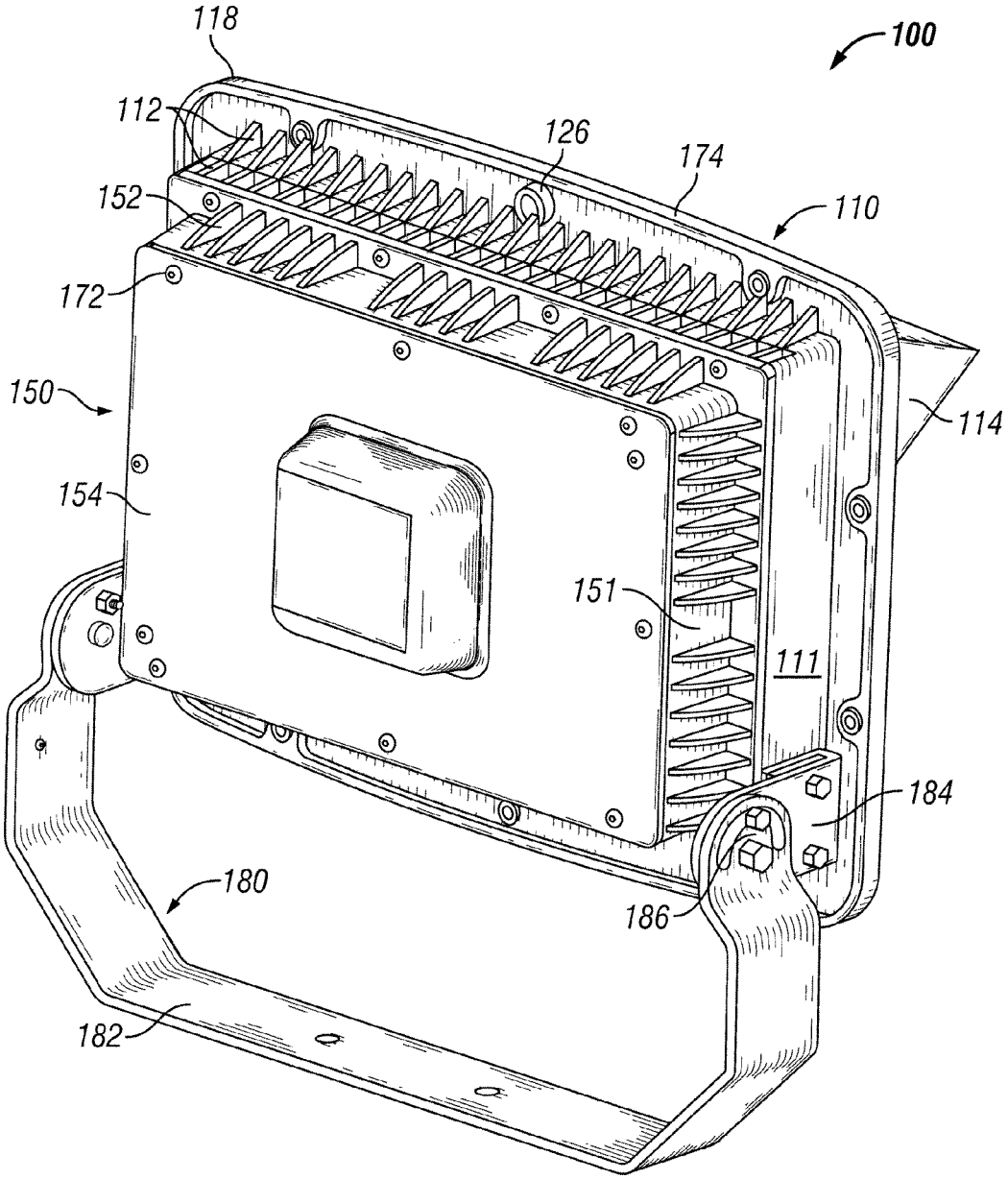
Figure 1C:
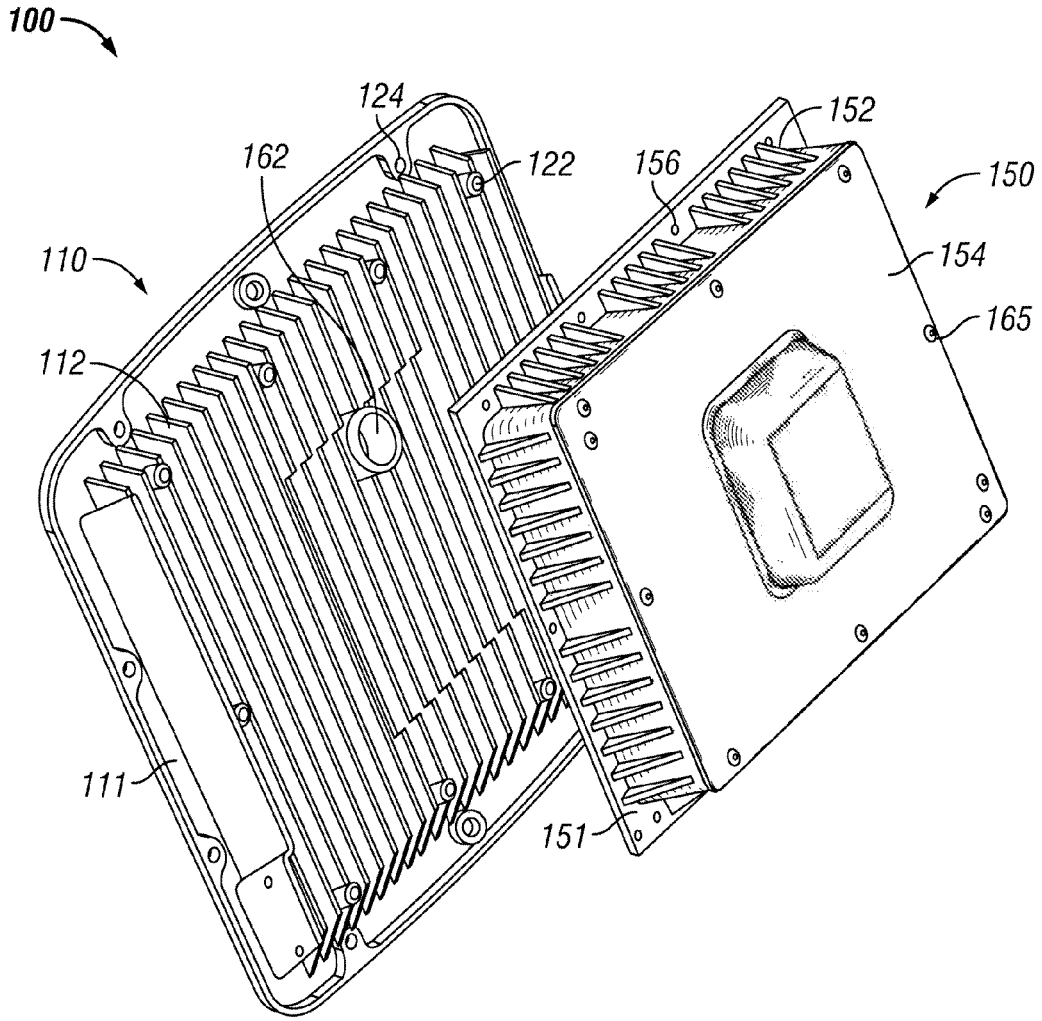

Exemplary embodiments of LED floodlights may meet one or more of a number of standards set by one or more of a number of authorities. Examples of such authohrities include, but are not limited to, the National Electric Code (NEC), the Canadian Electric Code (CEC), the IEC, the NEMA, Underwriter's Laboratories (UL), the Standards Council of Canada, Conformité Européenne (CE), and the Appareils destinés à être utilisés en Atmosphères Explosives (ATEX). Examples of such standards include, but are not limited to, Class I, division 2, groups A, B, C, and/or D; Class I, Zone 2; Class II, groups E, F, and/or G; Class III simultaneous presence; Marine and/or Wet locations; Type 4X; IP66; and Ex nA Zone 2. FIGS. 1A through 1C show various views of a rectangular LED floodlight 100 in which one or more exemplary embodiments may be implemented. In one or more embodiments, one or more of the components shown in FIGS. 1A through 1C may be omitted, repeated, and/or substituted. Accordingly, embodiments of a LED floodlight should not be considered limited to the specific arrangements of components shown in FIGS. 1A through 1C.

FIG. 1A depicts a front perspective view of the LED floodlight 100 in rectangular form, while FIG. 1B depicts a rear perspective view of the LED floodlight 100. The LED flood light 100 has a LED housing assembly 110, a driver housing assembly 150, and a mounting assembly 180. The LED housing assembly 110 includes a LED housing 111, a visor 114, a guard 116, a bezel 118, a number of reflectors 140, and a number of heat sink protrusions 112 that extend outward from the back surface of the LED housing 111. The driver assembly 150 includes a driver housing 151 and its own set of heat sink protrusions 152. The mounting assembly 180 includes a mounting bracket 182, a hinge plate 184, and a yoke bracket 186.

In certain exemplary embodiments, the LED housing 111 of the LED housing assembly 110 receives one or more of a number of components (e.g., LEDs, visor 114, reflectors 140) used to create light for the LED floodlight 100. The LED housing 111 may receive the one or more components in one or more of a number of ways, including but not limited to apertures (for fastening devices), slots, and clamps.

The LED housing 111 may be a single cast member or an assembly of two or more members. The LED housing 111 may be made of any suitable material, including metal (e.g., alloy, stainless steel), plastic, some other material, or any combination thereof. The LED housing 111 may be of any dimensions (e.g., thickness, width, height) suitable for the environment in which the LED floodlight 100 operates. For example, the thickness of the walls of the LED housing 111 may be a minimum amount required to meet the applicable standards. As another example, the front face of the rectangular LED housing 111 may be approximately 21 inches wide by approximately 16 inches high. The LED housing assembly 110 and its components are explained in more detail below with respect to FIGS. 2A and 2B.

Optionally, in certain exemplary embodiments, the visor 114 may be coupled to a portion of the LED housing assembly 110, specifically the front side of the LED housing 111. The visor 114 may be used to direct light in a certain direction and/or to prevent light from being directed in a certain direction. For example, when the LED floodlight 100 is operating, the visor 114 may be coupled to the top portion of the front side of the LED housing 111 to be compliant with dark sky regulations and concerns. The visor 114 may be made of one or more of any number of suitable materials, including but not limited to aluminum, plastic, an alloy, and stainless steel. The visor 114 may have any dimensions and/or shapes (e.g., length, width, angled portions, angle of angled portions, height). The visor 114 may be translucent, semi-translucent, or non-translucent. The visor 114 may be fixedly or detachably coupled to the LED housing 111. The visor 114 may be coupled to the LED housing 111 using one or more of a number of methods, including but not limited to epoxy, welding, snap fittings, and fastening devices (e.g., nut and bolt). The visor 114 may also be coupled to the bezel 118 and/or any other component of the LED housing assembly 110.

Optionally, in certain embodiments, the guard 116 may be coupled to a portion of the LED housing assembly 110, specifically the front side of the LED housing 111. The guard 116 may be used to protect one or more components (e.g., the optional lens, the reflectors 140, the LEDs) positioned on the front side of the LED housing assembly 110. The guard 116 may also be used in certain applications and/or to meet certain standards. For example, when the LED floodlight 100 is operating in a hazardous location, the guard 116 may be coupled to the front side of the LED housing 111 to be compliant with one or more applicable standards. The guard 116 may be made of one or more of any number of suitable materials, including but not limited to aluminum, plastic, an alloy, and stainless steel. The guard 116 may have any dimensions and/or shapes (e.g., width, height, thickness of bars, spacing between bars in one or more directions, orientation of the bars). The guard 116 may be fixedly or detachably coupled to the LED housing 111. The guard 116 may be coupled to the LED housing 111 using one or more of a number of methods, including but not limited to welding, snap fittings, and fastening devices (e.g., nut and bolt). The guard 116 may also be coupled to the bezel 118 and/or any other component of the LED housing assembly 110.

In one or more embodiments, the driver housing 151 of the driver housing assembly 150 receives one or more of a number of components (e.g., drivers, driver brackets, transformer) used to create power and control for the LED floodlight 100. The driver housing 151 may receive the one or more components in one or more of a number of ways, including but not limited to apertures (for fastening devices), slots, and clamps.

The driver housing 151 may be a single cast member or an assembly of two or more members. The driver housing 151 may be made of any suitable material, including metal (e.g., alloy, stainless steel), plastic, some other material, or any combination thereof. The driver housing 151 may be made of the same or a different material as the LED housing 111. The driver housing 151 may be of any dimensions (e.g., thickness, width, height) suitable for the environment in which the LED floodlight 100 operates. For example, the thickness of the walls of the driver housing 151 may be a minimum amount required to meet the applicable standards. The driver housing assembly 150 and its components are explained in more detail below with respect to FIGS. 3A through 3C.

In certain exemplary embodiments, the mounting assembly 180 provides for mounting the LED floodlight 100 and/or adjusting the direction of the light generated by the LED floodlight 100. The mounting assembly 180 may be made of any suitable material, including metal (e.g., alloy, stainless steel), plastic, some other material, or any combination thereof. The mounting assembly 180 may be made of the same or a different material as the LED housing 111 and/or the driver housing 151. The mounting assembly 180 and its components are explained in more detail below with respect to FIGS. 4A through 4E.

In one or more exemplary embodiments, the LED housing assembly 110 and the driver assembly 150 are separated by one or more air gaps. The air gaps may be used to maintain the temperature of the LED housing assembly 110 and/or the driver assembly 150 below a threshold temperature. The threshold temperature may represent an operating temperature at which the LED floodlight 100 and/or one or more components of the LED floodlight 100 may fail. The air gap between the LED housing assembly 110 and the driver assembly 150 may be created by one or more LED housing heat sink protrusions 112. For example, as shown in FIG. 1C, each LED housing heat sink protrusion 112 may extend from the back side of the LED housing 111 and abut against a front side (a mating side) of the driver housing 151.

The LED floodlight 100 shown in FIGS. 1A through 1C may be able to withstand one or more of a number of harsh environmental conditions. For example, the LED floodlight 100 may be able to withstand a minimum amount of vibration for a minimum amount of time while operating. As another example, the LED floodlight 100 may be able to withstand exposure to a minimum amount of water for a minimum amount of time.

In certain exemplary embodiments, the LED floodlight 100 is made of one or more cast components. In such a case, one or more of the cast components are finished with a grey epoxy powder coat paint. The grey epoxy powder coat paint may provide protection against fade and ware. The grey epoxy powder coat paint may be applied to the cast components in any thickness (e.g., 1 mill, 5 mils).

The shape of the front of the LED housing assembly 110 and the mating surface of the driver assembly 150, as shown in FIGS. 1A through 1C, are rectangular. However, other shapes (e.g., square, elliptical) may be used for the front of the LED housing assembly 110 and/or the mating surface of the driver assembly 150. For example, as shown in FIGS. 5A through 5D, the shape of the front of the LED housing assembly 110 and the shape of the front side of the driver assembly 150 may be circular. The shape of the front of the LED housing assembly 110 may be the same or different than the shape of the front side of the driver assembly 150.

Figure 2A:
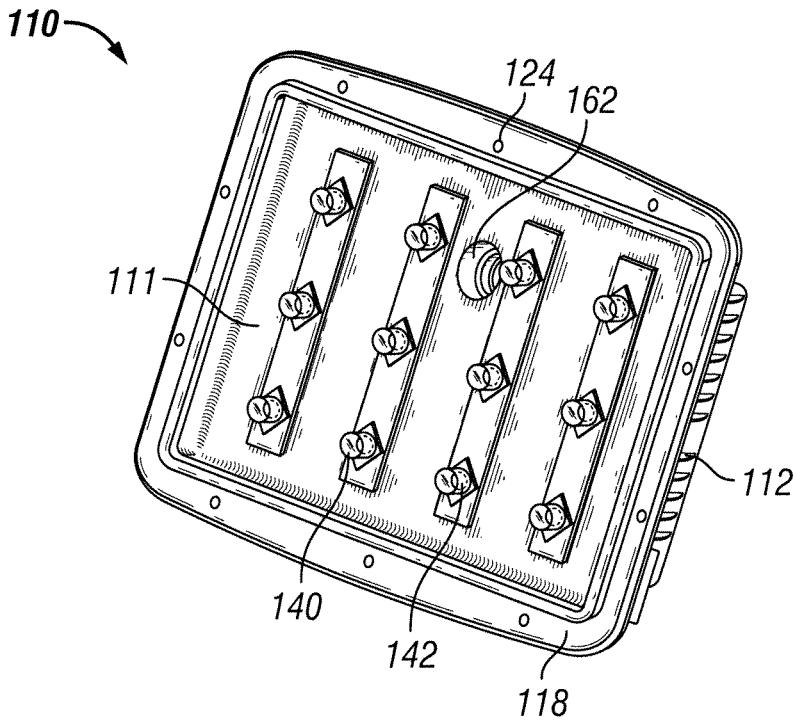
FIGS. 2A and 2B show various views of a LED housing assembly of a rectangular LED floodlight in accordance with one or more exemplary embodiments.
Figure 2B:
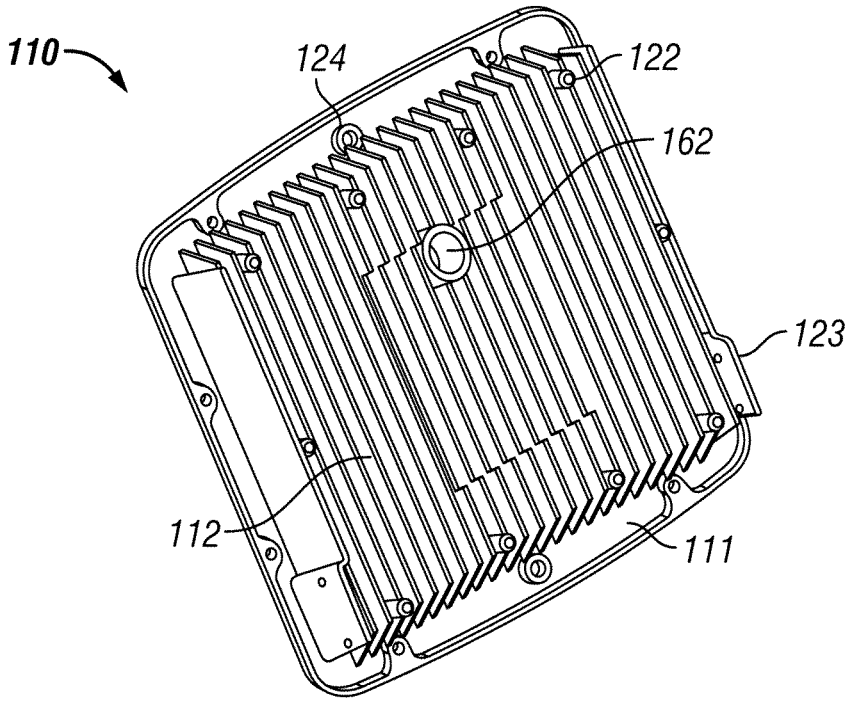

FIGS. 2A and 2B show various views of the LED housing assembly 100 of the rectangular LED floodlight 100 in accordance with one or more exemplary embodiments. In one or more embodiments, one or more of the components shown in FIGS. 2A and 2B may be omitted, repeated, and/or substituted. Accordingly, embodiments of a LED housing assembly should not be considered limited to the specific arrangements of components shown in FIGS. 2A and 2B.

The LED housing assembly 110 includes a LED housing 111 that has a front side (shown in FIG. 2A) and a back side (shown in FIG. 2B). A wiring aperture 162 traverses the LED housing 111 and receives one or more wires and/or one or more cables that are electrically coupled to the LEDs 142 on the front side of the LED housing 111 and to the drivers located in the driver housing, as described below with respect to FIGS. 3A through 3C.

As shown in FIG. 2A, the front side of the LED housing 111 is coupled to one or more of a number of components. For example, a bezel 118 is coupled to the outer perimeter of the front side of the LED housing 111. The bezel 118 may be of any thickness and/or width (i.e., distance from the outer edge toward the center of the bezel 118). The bezel 118 may be used for aesthetic and/or protective purposes. The bezel 118 may include one or more components, including but not limited to a gasket (not shown) positioned between the back side of the bezel 118 and the front side of the LED housing 111. The bezel 118 may also, or in the alternative, be used to secure a lens (not shown).

The bezel 118 may be coupled to the front side of the LED housing 111 using one or more of a number of methods or manners, including but not limited to bolting, welding, using epoxy, brazing, press fitting, mechanically connecting, using a flat joint, and using a serrated joint. For example, as shown in FIG. 2A, one or more fastening apertures 124 may be included in the bezel 118 and the LED housing 111 so that, when the bezel 118 is positioned in a certain way with respect the LED housing 111, the fastening apertures 124 align. In such a case, one or more of a number of fastening devices (e.g., screws, bolts) may traverse the fastening apertures 124 to couple the bezel 118 to the front side of the LED housing 111. Some or all of the surface (e.g., where the bezel 118 and/or gasket couples to the front side of the LED housing 111) of the front side of the LED housing 111 may be free of paint to provide a better seal and assure compliance with one or more of a number of standards, including but not limited to IP66.

Referring to FIG. 2A, the front side of the LED housing 111 also includes a number of LEDs 142 with a corresponding number of reflectors 140. The LEDs 142 may be an array of LEDs or a single LED. The LEDs 142 may one or more of any type of LED, including but not limited to chip-on-board and discrete. A thermal pad (not shown) and/or any other similar thermal device may be positioned between the LEDs 142 and the front side of the LED housing 111. The reflectors 140 may be positioned over the LEDs 142. The reflectors 140, LEDs 142, and/or any other components (e.g., thermal pads) associated with the LEDs may be coupled to the front side of the LED housing 111 using one or more of a number methods, including but not limited to epoxy, fastening devices (e.g., screws), and welding/soldering. One or more portions of the front side of the LED housing 111 may be raised, as shown in FIG. 2A, for example, to receive and/or dissipate heat generated by the LEDs 142, reflectors 140, and/or other components associated with the LEDs.

FIG. 2B shows the back side of the LED housing assembly 110. A number of heat sink protrusions 112 protrude from the back side of the LED housing 111. In certain exemplary embodiments, the heat sink protrusions 112 provide an air gap between the LED housing assembly 110 and the driver assembly 150 to maintain the temperature of the LED housing assembly 110 and the driver assembly 150 (and/or one or more of their components) below a threshold temperature. The heat sink protrusions 112 of the driver housing 111 may have varying shapes (e.g., thickness, height, curvature) and/or varying spacing along the back side of the LED housing 111.

For example, the heat sink protrusions 112 may be fins (e.g., blades). As another example, the heat sink protrusions 112 may be one or more undulations (e.g., a number of sine waves in series). The heat sink protrusions 112 may extend from the back side of the LED housing 111 perpendicularly or at some non-normal angle. Each heat sink protrusion 112 may extend from the back side of the LED housing 111 at the same or different angles relative to the other heat sink protrusions.

The heat sink protrusions 112 may have any of a number of configurations. As shown in FIG. 2B, the heat sink protrusions 112 may be linear. In such a case, the linear heat sink protrusions 112 may have a number of orientations along the back side of the LED housing 111. For example, the heat sink protrusions 112 may be parallel to each other and run vertically along at least a portion of the height of the back side of the LED housing 111. The heat sink protrusions 112 may also be parallel to each other and run horizontally along at least a portion of the width of the back side of the LED housing 111. The heat sink protrusions 112 may also be parallel to each other and run diagonally, at any of a number of angles, along at least a portion of the width of the back side of the LED housing 111.

The heat sink protrusions 112 may also run quasi-parallel to each other. In a quasi-parallel configuration, a portion of the heat sink protrusions 112 may be parallel to each other, while the remainder of the heat sink protrusions 112 are not parallel to the portion. For example, half of the heat sink protrusions 112 may be positioned vertically along the back side of the LED housing 111, while the other half of the heat sink protrusions 112 may be positioned horizontally along the back side of the LED housing 111. Those skilled in the art will appreciate that a number of other quasi-parallel configurations of the heat sink protrusions 112 along the back side of the LED housing 111 may be attained.

The heat sink protrusions 112 may also be non-linear and/or oriented antiparallel to each other. For example, the heat sink protrusions 112 may be sine waves that run parallel to each other in some orientation (e.g., vertical, horizontal) along the back side of the LED housing 111. As another example, the heat sink protrusions 112 may be concentric circles, positioned along the back side of the LED housing 111, that are centered at the center of the LED housing 111. Those skilled in the art will appreciate that a number of other non-linear and antiparallel configurations of the heat sink protrusions 112 along the back side of the LED housing 111 may be attained.

In certain exemplary embodiments, the back side of the LED housing 111 (specifically, the far end of the heat sink protrusions 112) includes one or more fastener receivers 122. The fastener receivers 122 receive fastener devices (not shown) to couple the LED housing assembly 110 to the driver assembly 150. The fastener receivers 122 may be configured in any manner appropriate to receive the corresponding fastener devices. For example, as shown in FIG. 2B, the fastener receiver 122 may be a threaded aperture that traverses some or all of the LED housing 111 from the back side of the LED housing 111 and receives a screw. As another example, the fastener receiver 122 may be a slot, integrated with the end of one or more of the heat sinks 112, that receives a clip or a clamp.

The LED housing 111 may also include one or more mounting assembly receivers 123. In the case shown in FIG. 2B, a mounting assembly receiver 123 is positioned on each side toward the bottom of the LED housing 111. The mount assembly receiver 123 may be configured in any manner appropriate to receive and couple to the mounting assembly. For example, as shown in FIGS. 1B and 2B, the mounting assembly receivers 123 may include one or more apertures for receiving fastening devices (e.g., bolts) to couple the mounting assembly to the LED housing 111. Another example of a mounting assembly receiver 123 is shown below with respect to FIGS. 5A through 5D.

Figure 3A:
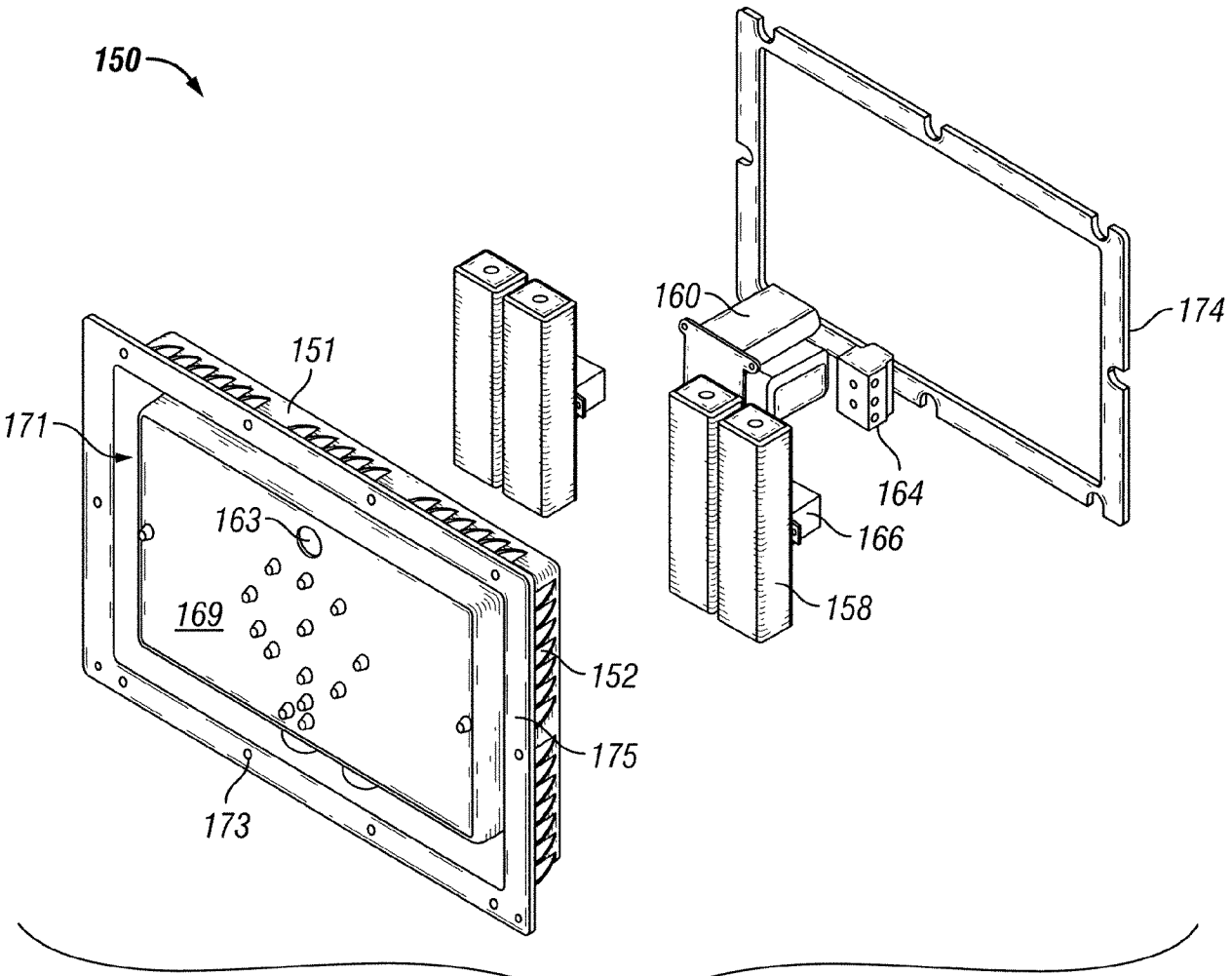
FIGS. 3A through 3C show various views of a driver housing assembly of a rectangular LED floodlight in accordance with one or more exemplary embodiments.
Figure 3C:
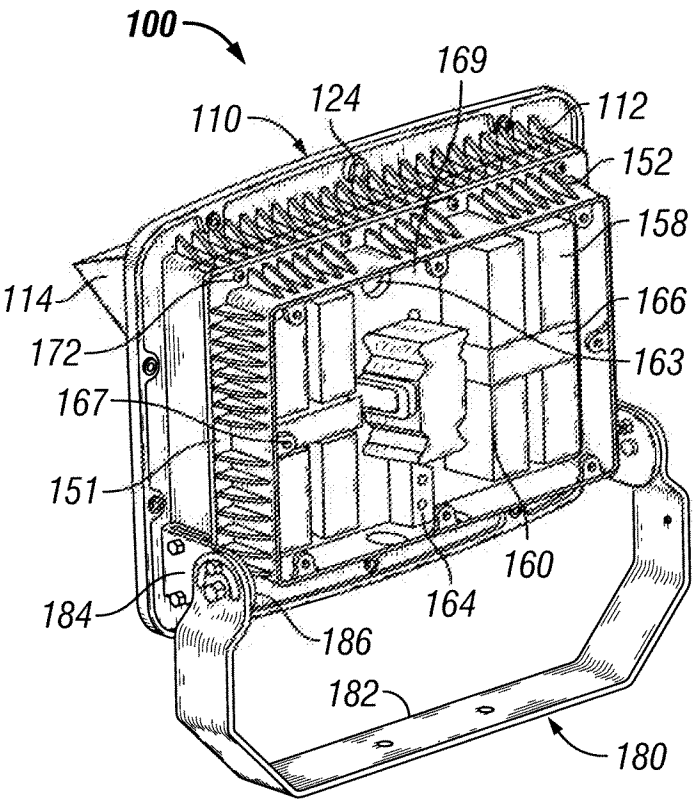
Figure 3B:
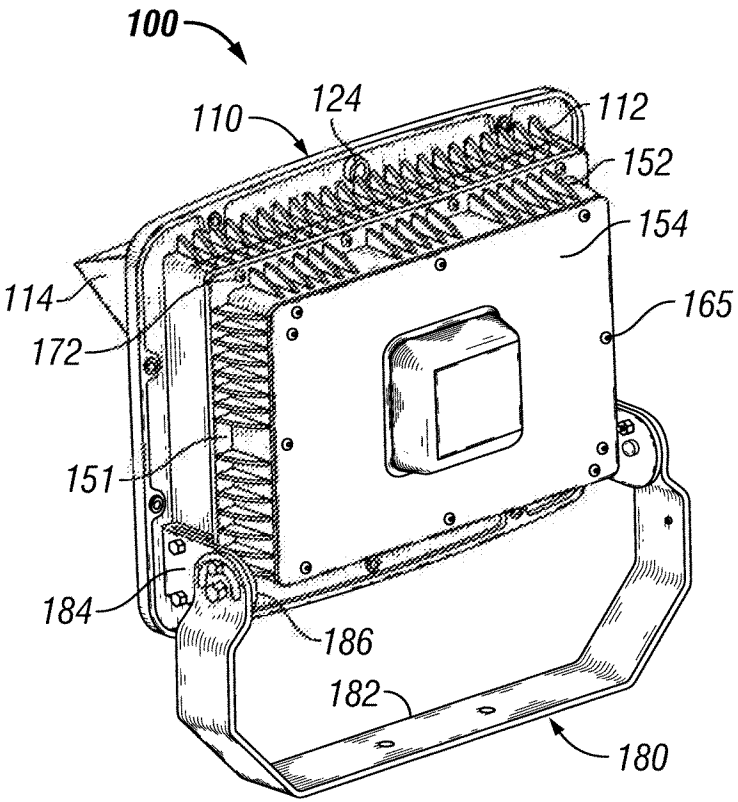

FIGS. 3A through 3C show various views of a driver assembly 150 of a rectangular LED floodlight 100 in accordance with one or more exemplary embodiments. In one or more embodiments, one or more of the components shown in FIGS. 3A through 3C may be omitted, repeated, and/or substituted. Accordingly, embodiments of a driver assembly should not be considered limited to the specific arrangements of components shown in FIGS. 3A through 3C.

The driver assembly 150 includes a driver housing 151 that has a front side (shown in FIG. 3A) and a back side (shown in FIG. 3B). The front side of the driver housing 151 may be larger (e.g., wider, higher) than the back side of the driver housing. A wiring aperture 163, corresponding to the wiring aperture 162 of the LED housing assembly, traverses the driver housing 151 and receives one or more wires and/or one or more cables that are electrically coupled to the LEDs 142 on the front side of the LED housing 111 (described above with respect to FIGS. 2A and 2B) and to the drivers located in the driver housing 151.

In certain exemplary embodiments, the driver housing 151 may include one or more heat sink protrusions 152 positioned around the perimeter of the driver housing 151. Unlike the heat sink protrusions 112 of the LED housing 111, the heat sink protrusions 152 of the driver housing 151 may not extend from the back side of the driver housing 151. The heat sink protrusions 152 of the driver housing 151 may have one or more of a number of dimensions (e.g., thickness, height) and one or more of a number of shapes (e.g., linear, curved, rectangular, crossed, straight). The spacing of the heat sink protrusions 152 may be constant and/or varying along the perimeter of the driver housing 151. The heat sink protrusions 152 may extend perpendicularly (i.e., normally) from the driver housing 151, as shown in FIG. 3B. The heat sink protrusions 152 may also, or in the alternative, extend from the driver housing 151 at a non-normal angle.

The front side of the driver housing 151 includes a mating surface 175 that couples to the end of the heat sink protrusions 112 extending from the back side of the LED housing 111. The mating surface 175 of the front side of the driver housing 151 may extend from the outer edge of the driver housing 151 to some distance (including completely) toward the center of the front side of the driver housing 151. In other words, a cavity may or may not be formed at the front side of the driver housing 151 by the mating surface 175.

In certain exemplary embodiments, the mating surface 175 includes one or more fastener receivers 173. The fastener receivers 173 may be aligned with corresponding fastener receivers 122 positioned on the back side of the LED housing 111. The fastener receivers 173 receive fastener devices (not shown) to couple the driver assembly 150 to the LED housing assembly 110. The fastener receivers 173 may be configured in any manner appropriate to receive the corresponding fastener devices. For example, as shown in FIG. 2B, the fastener receiver 173 may be a threaded aperture that traverses the driver housing 151 and receives a screw. As another example, the fastener receiver 173 may be a slot that receives a detachable clip or a clamp. The fastener receiver 173 may also include an integrated fastening device, such as a clip or clamp that is integrated with (e.g., fixedly coupled to) the driver housing 151.

If the mating surface 175 of the front side of the driver housing 151 only extends a partial way toward the middle of the driver housing 151, than a cavity results. The cavity 171 shown in FIG. 3A may be of any size (e.g., depth, width, height) for proper ventilation and/or cooling of components within the driver housing 151. The back side of the cavity 171 includes a back plate 169 onto which one or more of the components of the driver assembly 150 are mounted. The components may be mounted on the front side (facing the LED housing 111) of the back plate 169 and/or the back side of the back plate 169. The components may be mounted to the back plate 169 using one or more of a number of methods, including but not limited to epoxy, fastening devices (e.g., screws that are received by apertures in the back plate 169), and welding/soldering.

The back side of the driver housing 151 has a back cover 154 that is removably coupled to the driver housing 151. A gasket 174 may be positioned between the driver housing 151 and the back cover 154 to ensure proper sealing between the driver housing 151 and the back cover 154. A proper seal between the driver housing 151 and the back cover 154 may be needed to meet one or more standards, including but not limited to IP66. The back cover 154 may be cast and/or may be made of any suitable material, including but not limited to stainless steel, an alloy, plastic, and aluminum.

The back cover 154 may include one or more fastener receivers (shown in FIG. 3B as being occupied by fastening devices 165). The fastener receivers of the back cover 154 may align with corresponding fastener receivers 167 on the back side of the driver housing 151 when the back cover 154 is positioned in a certain manner with respect to the driver housing 151. The fastener receivers of the back cover 154 may receive fastener devices 165 to couple the back cover 154 to the driver housing 151. The fastener receivers may be configured in any manner appropriate to receive the corresponding fastener devices 165. For example, as shown in FIG. 3B, the fastener receiver may be a threaded aperture that traverses all or part of the driver housing 151 and receives a fastening device 165 that is a screw. The same screw may be received by a corresponding aperture 167 in the back side of the driver housing 151 to couple the back cover 154 to the driver housing 151. Alternatively, or in addition, one or more other fastening methods may be used to couple the back cover 154 to the driver housing 151.

When the back cover 154 is removed (detached) from the back side of the driver housing 151, as shown in FIG. 3C, one or more components mounted on the back side of the back plate 169 may be accessed. Accessing the components may allow a user to perform one or more of a number of actions, including but not limited to cleaning the components, maintaining the components, repairing the components, reconfiguring the components, and replacing the components. In certain exemplary embodiments, the back plate 169 and/or the back side of the driver housing 151 are not painted where the back plate 169 couples to the driver housing 151.

FIGS. 3A and 3C show some components that may be mounted on the back side of the back plate 169 in certain exemplary embodiments. Specifically, FIG. 3C shows a perspective back view of the LED floodlight 100 with the back cover 154 removed. For example, one or more drivers 158, one or more transformers 160, and/or one or more terminal blocks 164 may be coupled to the back side of the back plate 169. The one or more drivers 158 may be mounted to the back side of the back plate 169 using one or more driver brackets 166. A driver bracket 166 may be made of one or more of a number of materials, including but not limited to sheet metal. The drivers 158, driver brackets 166, transformers 160, and/or terminal blocks 164 may be coupled to the back side of the back plate 169 using one or more of a number of fastening methods, including but not limited to snapping features, epoxy, welding/soldering, and fastening devices (e.g., screws that are received by apertures in the back side of the back plate 169). Those skilled in the art will appreciate that one or more other components may be coupled to the back side of the back plate 169.

The number and/or orientation of the pairs of reflectors 140 and LEDs 142 on the front side of the LED housing 111 may vary based on one or more of a number of factors, including but not limited to the shape of the LED floodlight, the size of the front side of the LED floodlight, the application for which the LED floodlight is used, and the wattage of the LEDs 142. For example, for the rectangular LED floodlight 100 shown in FIGS. 1A and 2A, the pairs of reflectors 140 and LEDs 142 are arranged in a matrix of three rows and four columns, where each row and column, together or independently, is evenly spaced apart. In such a case, as shown in FIGS. 1C, 3A, and 3C, there may be four drivers 158, two positioned on either side of the transformer 160, coupled to the back side of the back plate 169 of the driver housing 150.

Other quantities and/or orientations of the pairs of reflectors 140 and LEDs 142 may be used for the rectangular LED floodlight 100. For example, the pairs of reflectors 140 and LEDs 142 may be arranged in a matrix of two rows and four columns, where each row and column, together or independently, is evenly spaced apart. In such a case, there may be three drivers 158 (one driver 158 positioned on one side of the transformer 160 and two on the other side of the transformer 160) coupled to the back side of the back plate 169 of the driver housing 150. As another example, the pairs of reflectors 140 and LEDs 142 may be arranged in a matrix of three rows and two columns, where each row and column, together or independently, is evenly spaced apart. In such a case, there may be two drivers 158 (one driver 158 positioned on one side of the transformer 160 and one on the other side of the transformer 160, or both drivers 158 positioned on one side of the transformer 160) coupled to the back side of the back plate 169 of the driver housing 150. As yet another example, the pairs of reflectors 140 and LEDs 142 may be arranged in a matrix of two rows and two columns, where each row and column, together or independently, is evenly spaced apart. In such a case, there may be two drivers 158 (one driver 158 positioned on one side of the transformer 160 and one on the other side of the transformer 160, or both drivers 158 positioned on one side of the transformer 160) coupled to the back side of the back plate 169 of the driver housing 150.

FIGS. 4A through 4E show various views of a mounting assembly 180 for a LED floodlight 100 in accordance with one or more exemplary embodiments. In one or more embodiments, one or more of the components shown in FIGS. 4A through 4E may be omitted, repeated, and/or substituted. Accordingly, embodiments of a mounting assembly should not be considered limited to the specific arrangements of components shown in FIGS. 4A through 4E. For example, the mounting assembly 180 may include or be used with a SFA6 slipfitter adapter (not shown).

Figure 4A:
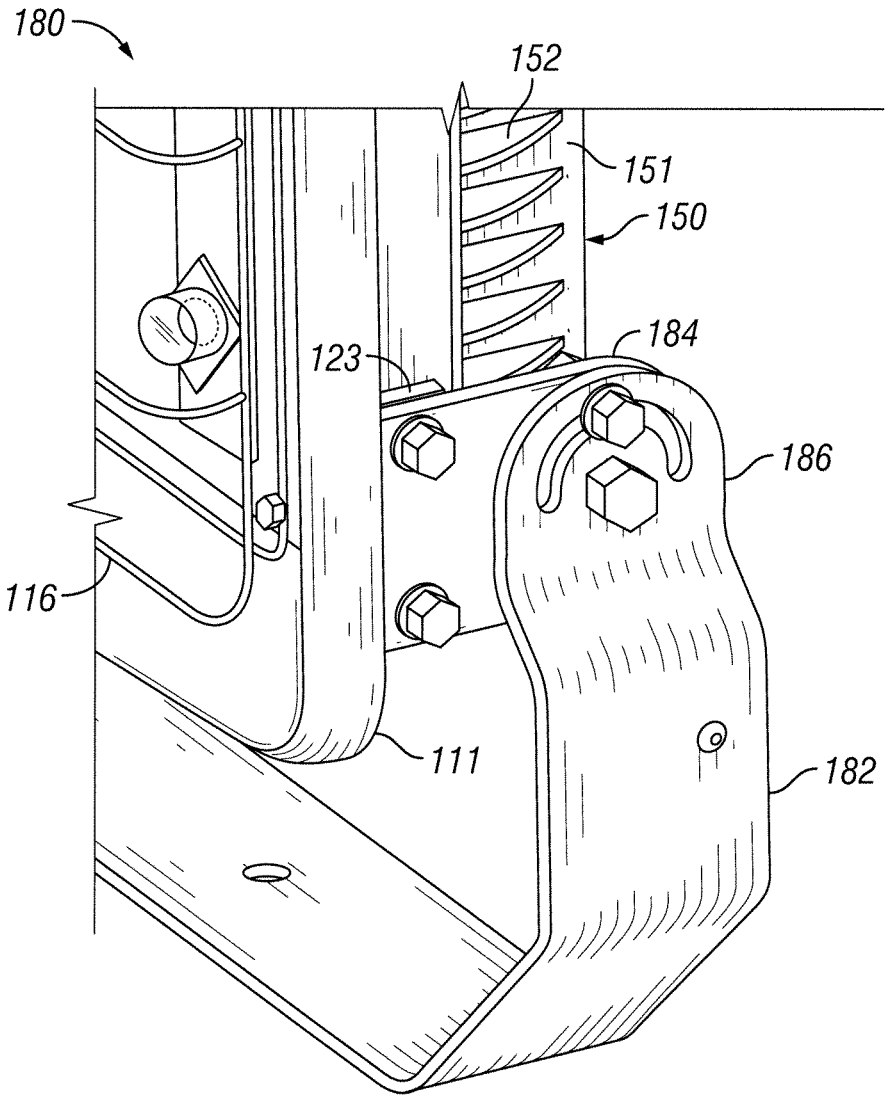
FIGS. 4A through 4E show various views of a mounting assembly for a LED floodlight in accordance with one or more exemplary embodiments.

FIG. 4A shows an exemplary mounting assembly 180 and includes a mounting bracket 182, a hinge plate 184, and a yoke bracket 186. In certain exemplary embodiments, the hinge plate 184 couples to the LED housing assembly 110 and/or the driver assembly 150. For example, as shown in FIG. 4A, the hinge plate 184 is coupled to the mounting assembly receiver 123 positioned toward the bottom of the LED housing 111. The hinge plate 184 may be coupled to the LED housing assembly 110 and/or the driver assembly 150 on one or more of a number of ways, including but not limited to epoxy, welding/soldering, and fastening devices.

The hinge plate, yoke bracket 186, and/or mounting bracket 182 may be made of one or more of a number of materials, including but not limited to aluminum, an alloy, plastic, and stainless steel. The characteristics (e.g., dimensions, shape, material) of the components (e.g., mounting bracket 182, hinge plate 184, yoke bracket 186) of the mounting assembly 180 may be such that the mounting assembly 180 safely and reliably couples to the remainder of the LED floodlight 100 in any suitable environment and/or for any duration of time during the operation of the LED floodlight 100.

The yoke bracket 186 may include one or more features (e.g., slots) that allow a user to rotate, tilt, swivel, or otherwise move the light generated by the LED floodlight in a particular vertical direction and/or angled position. For example, the yoke bracket 186 in FIGS. 4A-4E allow the light generated by the LED floodlight to be directed at any point within a 180° arc. There may be more than one yoke bracket 186 for the mounting assembly 180. The mounting bracket 182 may be coupled to the yoke bracket 186. The mounting bracket 182 may be coupled to an external feature (e.g., a pole 187, a side of a building) to secure the LED floodlight 100 in a fixed or relative position. The mounting bracket 182 may be coupled to one or more features in one or more of a number of ways, including but not limited to fastening devices (e.g., bolts) that traverse apertures in the mounting bracket 182.

Figure 4B:
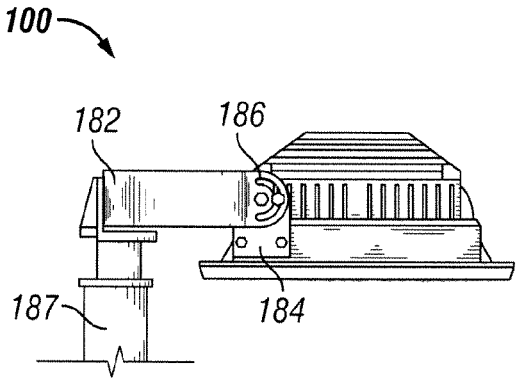
Figure 4C:
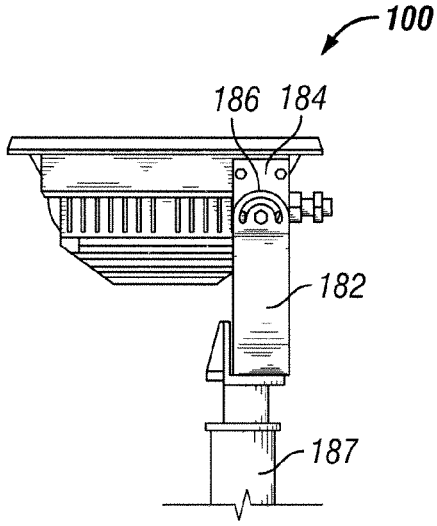
Figure 4D:
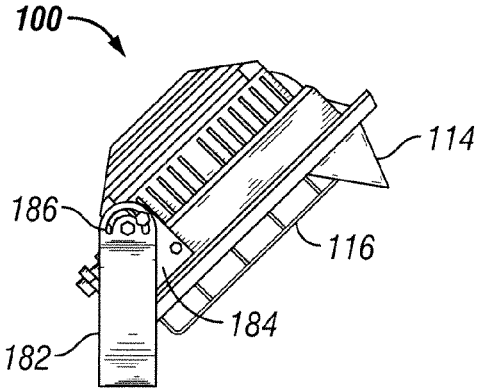
Figure 4E:
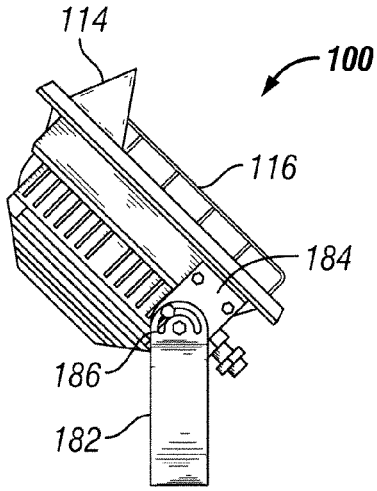

As shown in FIGS. 4B through 4E, the mounting assembly 180 is coupled to a pole 187. FIG. 4B shows the mounting assembly 180 manipulated in such a way as to direct the light generated by the LED floodlight 100 approximately downward) (0°). FIG. 4C shows the mounting assembly 180 manipulated in such a way as to direct the light generated by the LED floodlight 100 approximately upward) (180°). FIG. 4D shows the mounting assembly 180 manipulated in such a way as to direct the light generated by the LED floodlight 100 at approximately a 45° angle. FIG. 4E shows the mounting assembly 180 manipulated in such a way as to direct the light generated by the LED floodlight 100 at approximately a 135° angle. The mounting assembly 180 allows the LED floodlight 100 to be mounted vertically, horizontally, and/or at any other angle.

FIGS. 5A through 5D show various views of a circular LED floodlight 500 in accordance with one or more exemplary embodiments. In one or more embodiments, one or more of the components shown in FIGS. 5A through 5D may be omitted, repeated, and/or substituted. Accordingly, embodiments of a circular LED floodlight should not be considered limited to the specific arrangements of components shown in FIGS. 5A through 5D. For example, although not shown in FIGS. 5A through 5D, the circular LED floodlight 500 may include a visor and/or a guard. Further, those skilled in the art will appreciate that the LED floodlight may have one or more other shapes, including but not limited to square and elliptical.

Aside from the shape and/or configuration, the components and their functionality/properties are substantially the same as the corresponding components described above with respect to the rectangular LED floodlight 100 of FIGS. 1A through 3C. Specifically, the LED housing assembly 510 (including one or more of its components such as the LED housing 511, the bezel 518, the heat sink protrusions 512, the fastening apertures 524, the wiring aperture 562, the optional visor, the optional guard, the LEDs, and the reflectors 540), the driver assembly 550 (including one or more of its components such as the driver housing 551, the heat sink protrusions 552, the wiring aperture 563, the driver 558, and the transformer 560), and the mounting assembly 580 (including one or more of its components such as the mounting bracket 582 and the hinge plate 584) are substantially similar to the corresponding components described above with respect to the rectangular LED floodlight 100 of FIGS. 1A through 4E.

The dimensions of the components of the circular LED floodlight 500 may vary. For example, the diameter of the front side of the LED housing 511 may be approximately 16.3 inches. Further, the distance from the front side of the LED housing 511 to the back plate 554 of the driver housing 550 may be approximately 6.8 inches. If a mounting assembly receiver 523 is coupled to the back plate 554, then the distance from the front side of the LED housing 511 to the end of the mounting assembly receiver 523 may be approximately 10.3 inches.

Figure 5A:
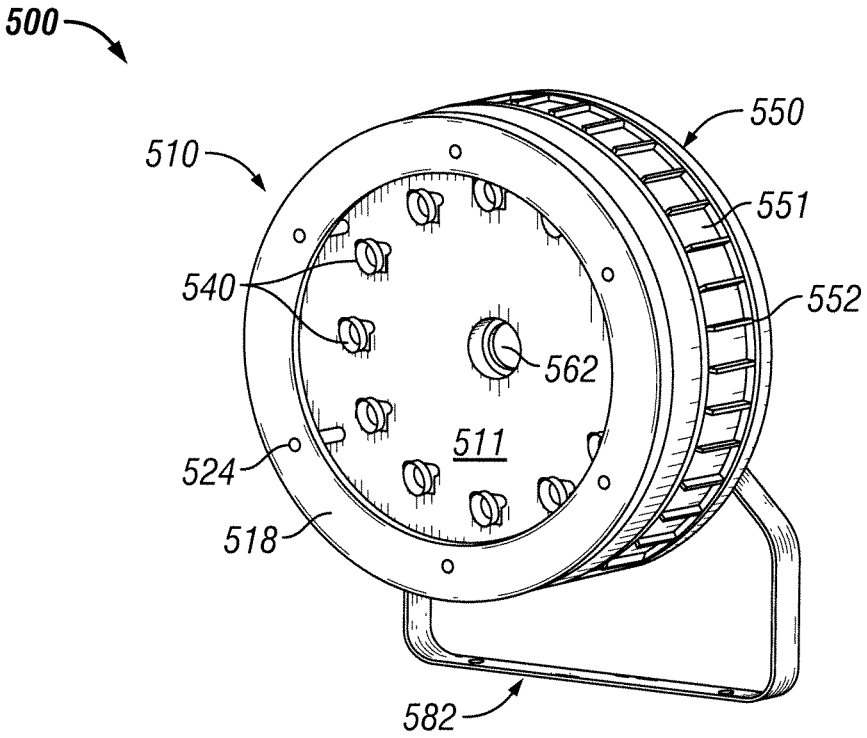
FIGS. 5A through 5D show various views of a circular LED floodlight in accordance with one or more exemplary embodiments.
Figure 5B:
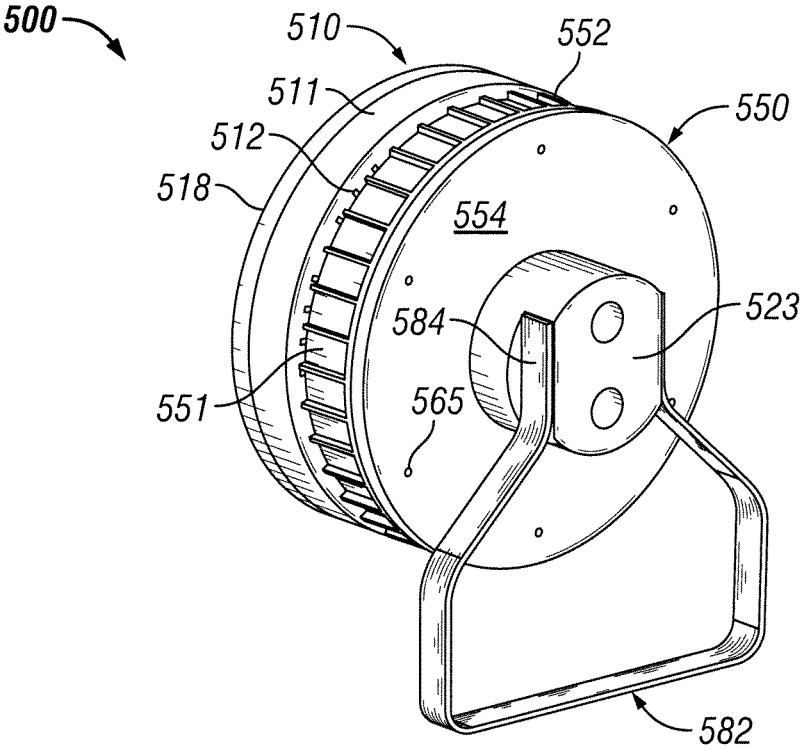
Figure 5C:
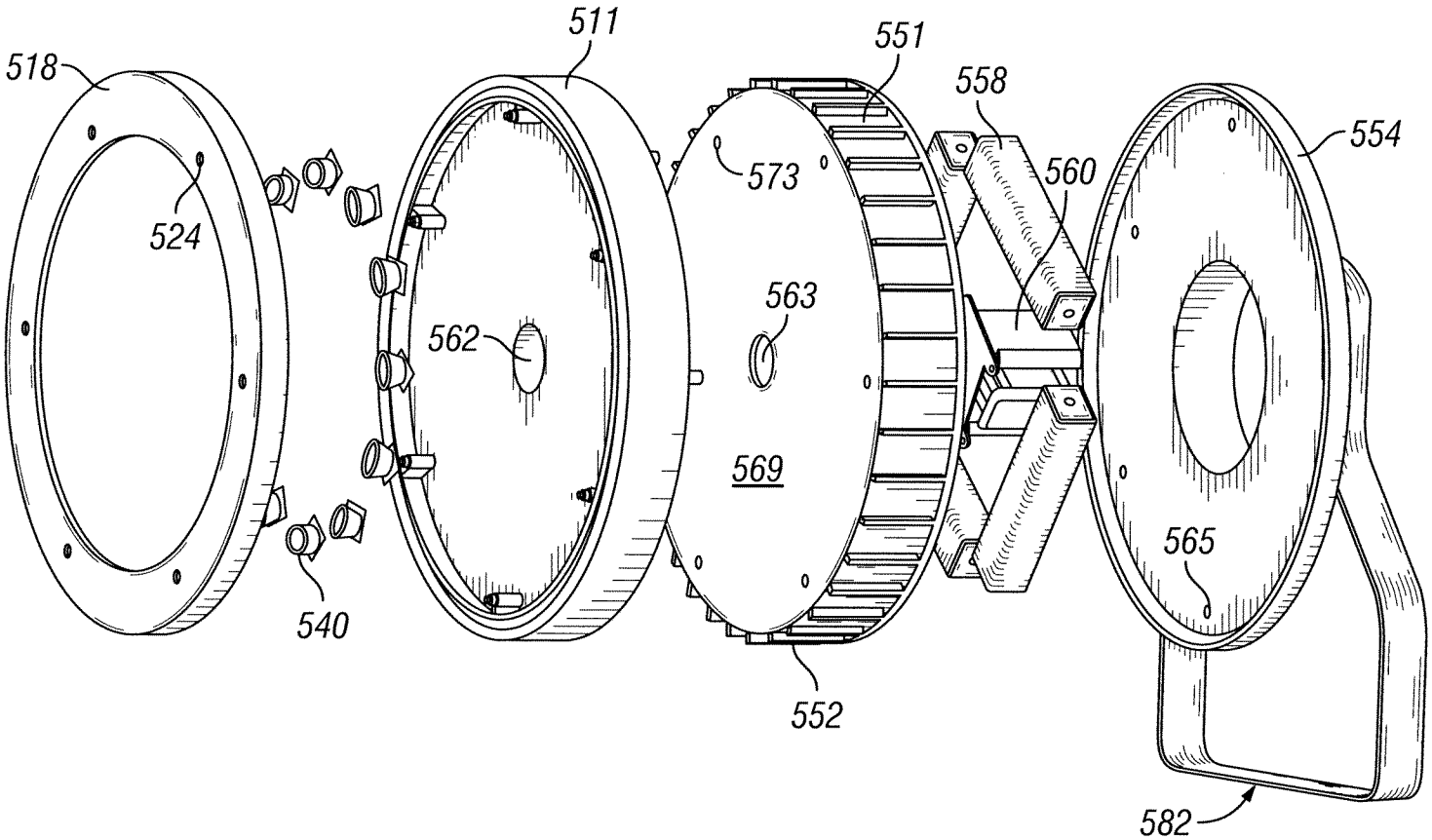
Figure 5D:
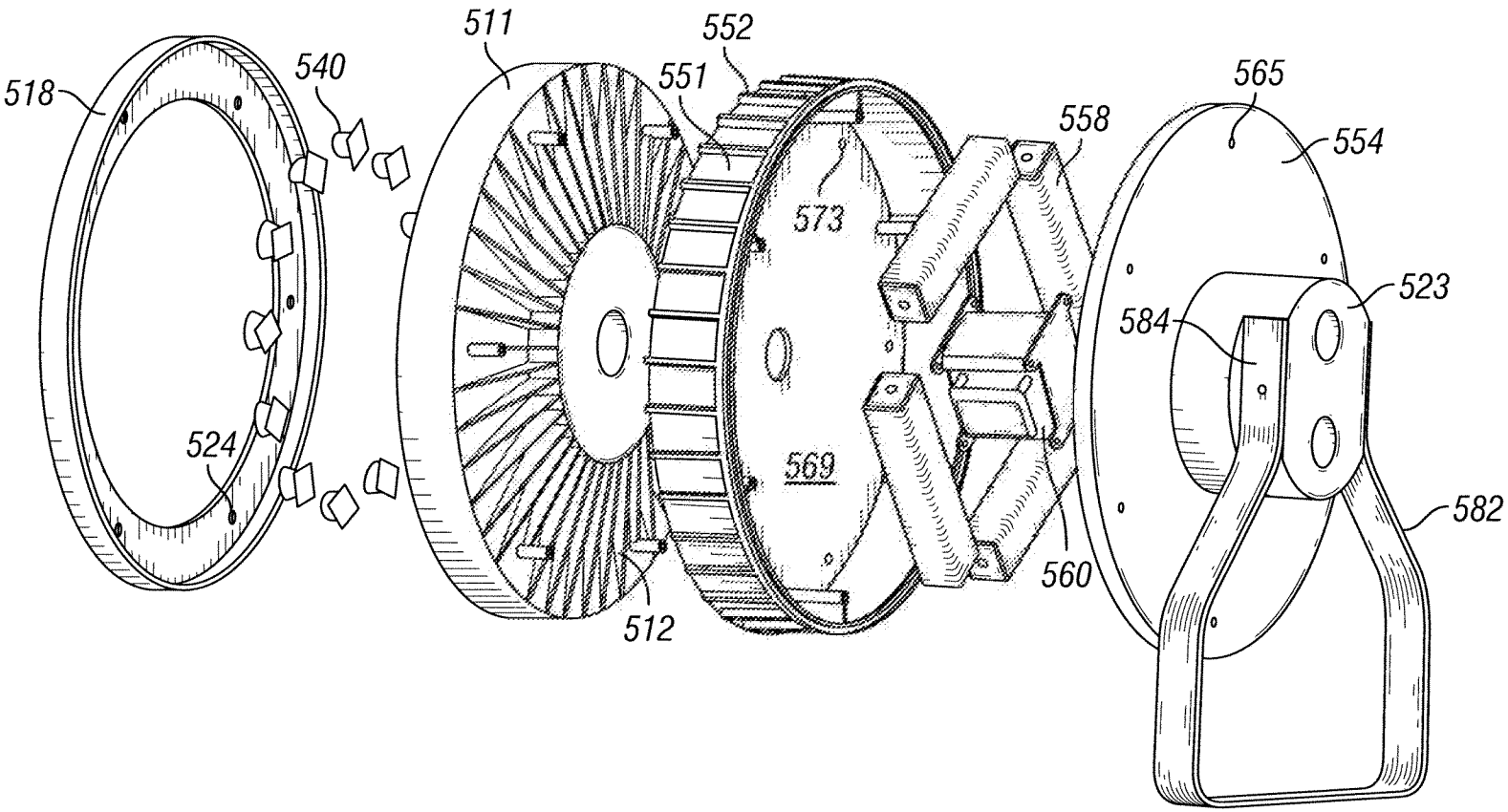

Further, as described above, other quantities and/or orientations of the pairs of reflectors 540 and LEDs, as well as the components (e.g., drivers 558, transformer 560) positioned in the driver housing 550, different from that shown in FIG. 5A, may be used for the circular LED floodlight 500. Likewise, various quantities and/or orientations of the pairs of reflectors and LEDs, as well as the components (e.g., drivers, transformer) positioned in the driver housing, may be used for a LED floodlight of any other shape (e.g., square, elliptical).

FIGS. 6A through 6E show various views of a reflector 140 in accordance with one or more exemplary embodiments. In one or more embodiments, one or more of the components shown in FIGS. 6A through 6E may be omitted, repeated, and/or substituted. Accordingly, embodiments of a reflector should not be considered limited to the specific arrangements of components shown in FIGS. 6A through 6E. For example, those skilled in the art will appreciate that the reflector may have one or more other shapes, including but not limited to square.

Figure 6A:
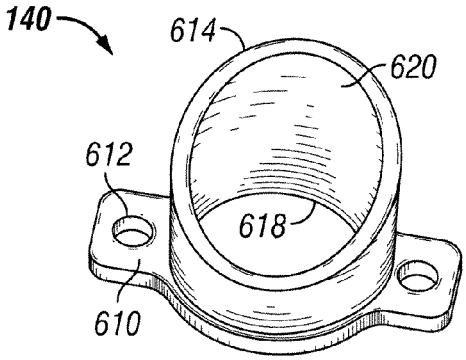
FIGS. 6A through 6E show various views of an exemplary reflector according to one or more exemplary embodiments.

FIG. 6A shows a perspective front view of the reflector 140. The reflector 180 includes a base 610 having a fastener receiver 612. The base 610 may be shaped as a flange. In certain exemplary embodiments, the base is coupled to the bottom portion 618 of the reflector body 620. The base 610 may be positioned on one side of the reflector 140, on opposite sides of the reflector 140 (as shown in FIG. 6A), all around the reflector 140, or some other portions of the reflector 140. The bottom of the base 610 may be flush with the bottom portion 618 of the reflector body 620. Alternatively, the bottom of the base 610 may be higher or lower than the bottom portion 618 of the reflector body 620. The fastener receiver 612 may also be located separately from the base and positioned elsewhere on the reflector body 620.

In one or more exemplary embodiments, the base 610 and the reflector body 620 may be a continuous piece (e.g., unibody construction, cast construction). Alternatively, the base 610 may be a separate piece that is coupled to the reflector body 620. In such a case, the base 610 may be coupled to the reflector body 620 in one or more of a number of ways, including but not limited to welding, threaded coupling, snap fittings, and fastening devices. The base 610 and the reflector body 620 may be made of the same or different materials. The base 610 and reflector body 620 may be made of any one or more of a number of materials, including but not limited to aluminum, stainless steel, glass, and an alloy.

The one or more fastener receivers 612 of the base 610 may be used to couple the reflector 140 to the front side of the LED housing. The fastener receivers 612 may be configured in any suitable manner to couple the reflector 140 to the front side of the LED housing. For example, if the fastener is a screw, then the fastener receiver 612 is an aperture that traverses the base 612 and receives the screw to couple the reflector 140 to the front side of the LED housing. As another example, if the fastener is a clamp, than the fastener receiver 612 may be a slot in the base 610 that allows the clamp to couple the reflector 140 to the front side of the LED housing. In certain exemplary embodiments, the base 610 and the fastener receiver 612 are the same component.

Figure 6B:
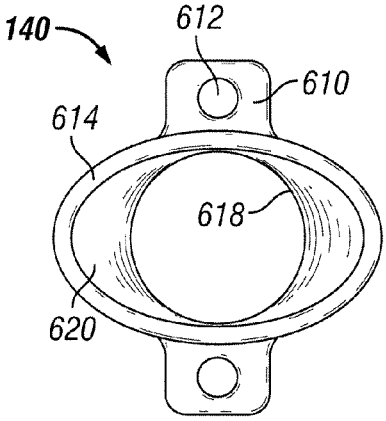
Figure 6C:
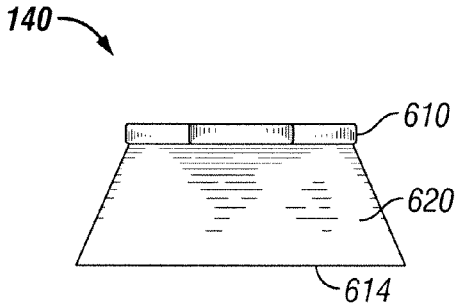
Figure 6D:
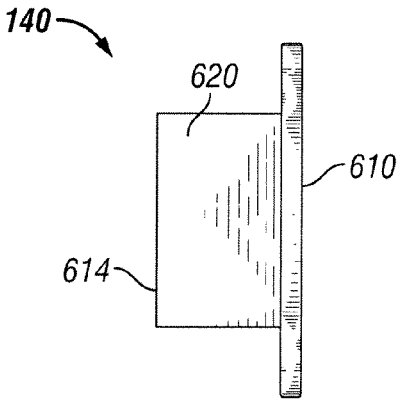
Figure 6E:
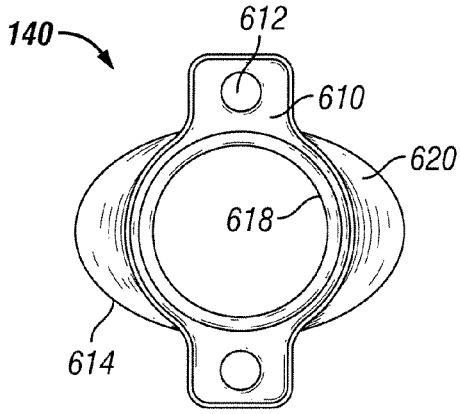

In one or more exemplary embodiments, the reflector body 620 is shaped in such a way that the shape of the top portion 614 of the reflector body 620 is an elongated version of the bottom portion 618 of the reflector body 620. The elongated version of the top portion 614 relative to the bottom portion 618 may be in one dimension (e.g., along the x-axis), two dimensions (e.g., along the x-axis and the y-axis), or three dimensions (as when the plane of the bottom portion 618 is antiparallel with the plane of the top portion 614). For example, as shown in FIGS. 6B and 6E, the top portion 614 of the reflector body 620 is shaped as an ellipse, while the bottom portion 618 of the reflector body 620 is shaped as a circle. The height of the ellipse formed by the top portion 614 in FIGS. 6B and 6E is approximately the same as the diameter of the circle formed by the bottom portion 618. For example, the circle formed by the bottom portion 618 may be approximately 16.8 mm, while the ellipse formed by the top portion 614 may be approximately 28 mm along the x-axis and 17.25 mm along the y-axis. In such a case, the elongation substantially occurs in one dimension.

The sides of the reflector body 620 may be linear and/or curved between the bottom portion 618 and the top portion 614. The sides of the reflector body 620 shown in FIGS. 6A through 6E are linear throughout. The sides of the reflector body 620 may be treated to meet one or more of a number of performance parameters. Examples of such performance parameters may include, but are not limited to, reflectance level, heat transfer, and corrosion resistance. For example, the inside of the reflector body 620 may be vacuum metallized to have a mirror like finish to cause the reflectance level to exceed 92%. In such a case, the coating on the inside of the reflector body 620 may be between 0.05 μm and 0.2 μm.

The walls of the reflector body 620 may have a thickness that is uniform and/or variable along the length of the reflector body 620. For example, as shown in FIGS. 6A through 6E, the walls of the reflector body 620 are approximately 1.75 mm uniformly through the reflector body 620. Likewise, the thickness of the base 610 may be uniform and/or variable throughout the base 610. For example, as shown in FIGS. 6A through 6E, the thickness of the base 610 is approximately 2.32 mm throughout the base 610.

In certain exemplary embodiments, the aperture formed by the bottom portion 614 of the reflector body 620 is disposed on one plane, while the aperture formed by the top portion 618 of the reflector body 620 is disposed on another plane. The aforementioned planes may be parallel to each other. In such a case, the height of the reflector 140, looking from a side view, is constant throughout. For example, the height of the reflector 140 shown in FIG. 6C may be approximately 13 mm. Alternatively, the aforementioned planes may be antiparallel, in which case the height of the reflector 140, from a side view, would vary along the reflector 140.

Using exemplary embodiments of reflectors described herein, the lighting efficiency increases. For example, for a NEMA 7X6 light fixture with 12 LEDs paired with 12 reflectors, the efficiency (including material absorption losses) is approximately 89%. In this case, each LED is rated for 1200 lumens (14,400 lumens in total) with a maximum illuminance of 0.75 Lux (over 65 meters) and a maximum illuminance of 3.3 Lux. For this example, the area illuminated was 120 m by 120 m. Further, the field angle was 95°×75° (50% brightness) and the beam angle was 120°×120° (10% brightness).

Embodiments of the present invention also provide for LED floodlights of various shapes and sizes where heat sink protrusions are strategically placed between the LED housing and the driver assembly to allow for improved air flow to improve the reliability and availability of the LED floodlight by keeping the temperature of the LED floodlight below a threshold temperature. Exemplary embodiments described herein also allow for ease in maintaining, cleaning, and/or replacing one or more components of the driver assembly by having a removable back plate to allow access inside the driver housing. Exemplary embodiments of the LED floodlights described herein are designed to meet one or more of a number of standards and/or regulations to be used in a variety of conditions.

Although the inventions are described with reference to preferred embodiments, it should be appreciated by those skilled in the art that various modifications are well within the scope of the invention. From the foregoing, it will be appreciated that embodiments of the LED floodlight and the reflector overcome the limitations of the prior art. Those skilled in the art will appreciate that the LED floodlight and the reflector are not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the LED floodlight and the reflector will suggest themselves to practitioners of the art. Therefore, the scope of the LED floodlight and the reflector is not limited herein.

What is claimed is:

1. A light emitting diode (LED) floodlight, comprising:

a LED housing assembly comprising:

a plurality of LEDs mounted on a first front side of a LED housing; and a first plurality of heat sink protrusions extending from a back side of the LED housing;

a driver assembly comprising a driver and a driver housing having a second front side, wherein the second front side is coupled to the first plurality of heat sink protrusions extending from the back side of the LED housing, and wherein the driver controls the plurality of LEDs in the LED housing; and a plurality of air gaps positioned between the second front side of the driver housing, the back side of the LED housing, and the first plurality of heat sink protrusions.

2. The LED floodlight of claim 1, wherein the LED housing further comprises a plurality of reflectors comprising a bottom portion in a first plane and a top portion in a second plane, wherein the plurality of LEDs are positioned within the plurality of reflectors at the bottom portion, and wherein a first shape of the top portion is an elongated version of a second shape of the bottom portion.

3. The LED floodlight of claim 2, wherein the first shape of the top portion is an ellipse, and where in the second shape of the bottom portion is a circle.

4. The LED floodlight of claim 3, wherein the second shape is elongated in one dimension relative to the first shape.

5. The LED floodlight of claim 3, wherein the first plane and the second plane are parallel.

6. The LED floodlight of claim 2, wherein each of the plurality of reflectors comprises an identical reflector shape as a remainder of the plurality of reflectors.

7. The LED floodlight of claim 1, wherein the front side of the LED housing has a substantially similar shape as the back side of the LED housing.

8. The LED floodlight of claim 7, wherein the back side of the LED housing and the second front side of the driver housing comprise the substantially similar shape.

9. The LED floodlight of claim 8, wherein the back side of the LED housing and the second front side of the driver housing are circular.

10. The LED floodlight of claim 8, wherein the back side of the LED housing and the second front side of the driver housing are rectangular.

11. The LED floodlight of claim 1, further comprising a visor coupled to the front side of the LED housing.

12. The LED floodlight of claim 1, wherein the driver housing further comprises a second plurality of heat sink protrusions.

13. The LED floodlight of claim 1, wherein the driver housing further comprises a removable back cover.

14. The LED floodlight of claim 13, wherein the driver is accessible when the removable back cover is removed.

15. The LED floodlight of claim 1, further comprising a mounting bracket coupled to the driver housing, wherein the mounting bracket is coupled to the driver housing a hinge plate.

16. The LED floodlight of claim 14, wherein the driver is accessible when the driver housing remains coupled to the LED housing.

17. The LED floodlight of claim 12, wherein the second plurality of heat sink fins are disposed on at least one side of the driver housing.

18. The LED floodlight of claim 1, further comprising a mounting bracket coupled to the LED housing, wherein the mounting bracket is coupled to the LED housing a hinge plate.

19. The LED floodlight of claim 18, wherein the driver housing further comprises a removable back cover that can be removed when the mounting bracket is coupled to the LED housing.

20. The LED floodlight of claim 18, wherein the driver housing and the LED housing can have an adjustable position using the mounting bracket.

* * * * *